United States Patent [19]

Miller et al.

[11] 4,359,003

[45] Nov. 16, 1982

[54] RAILWAY CAR CENTER FILLER

[75] Inventors: Roy W. Miller, Highland, Ind.; Bhaskara R. Mutyala, Birmingham, Ala.

[73] Assignee: Pullman Incorporated, Chicago, Ill.

[21] Appl. No.: 200,729

[22] Filed: Oct. 27, 1980

[51] Int. Cl.[3]..... B61F 1/02; B61F 1/4; B61F/5/16

[52] U.S. Cl. ..... 105/420; 105/199 C; 105/228; 213/57

[58] Field of Search ..... 105/420, 199 C, 228, 105/420; 213/57; 308/138

[56] References Cited

U.S. PATENT DOCUMENTS

| | | | |
|---|---|---|---|
| 2,143,216 | 1/1939 | Tesseyman et al. | 105/420 X |
| 2,352,718 | 7/1944 | Kassler | 213/57 |
| 2,355,524 | 8/1944 | Garlock et al. | 213/57 |
| 2,569,372 | 9/1951 | Collison | 105/420 X |
| 3,631,811 | 1/1972 | Christian | 105/420 X |
| 3,677,198 | 7/1972 | Yang et al. | 105/420 |
| 3,770,139 | 11/1973 | Glenn | 213/57 |
| 3,985,235 | 10/1976 | Buzza | 105/420 X |
| 4,130,068 | 12/1978 | Stark et al. | 105/420 |
| 4,180,001 | 12/1979 | McNally | 105/420 |
| 4,206,710 | 6/1980 | Spence | 105/420 |

*Primary Examiner*—Robert B. Reeves
*Assistant Examiner*—Howard Beltran
*Attorney, Agent, or Firm*—Richard J. Myers

[57] ABSTRACT

A modular center filler for railway vehicles comprising an inverted U-shaped core member fitted between front and rear cover plates and securely attached to a bottom cover plate to which a center plate is attached. Downwardly extending legs of the core are aligned with corresponding inner, beveled edges of the center plate which receive high forces during transit as a car rocks back and forth. The core member is positioned to receive these forces and transmit them into the center filler structure, car bolster and car body framing for even distribution throughout the vehicle.

8 Claims, 5 Drawing Figures

FIG. 3
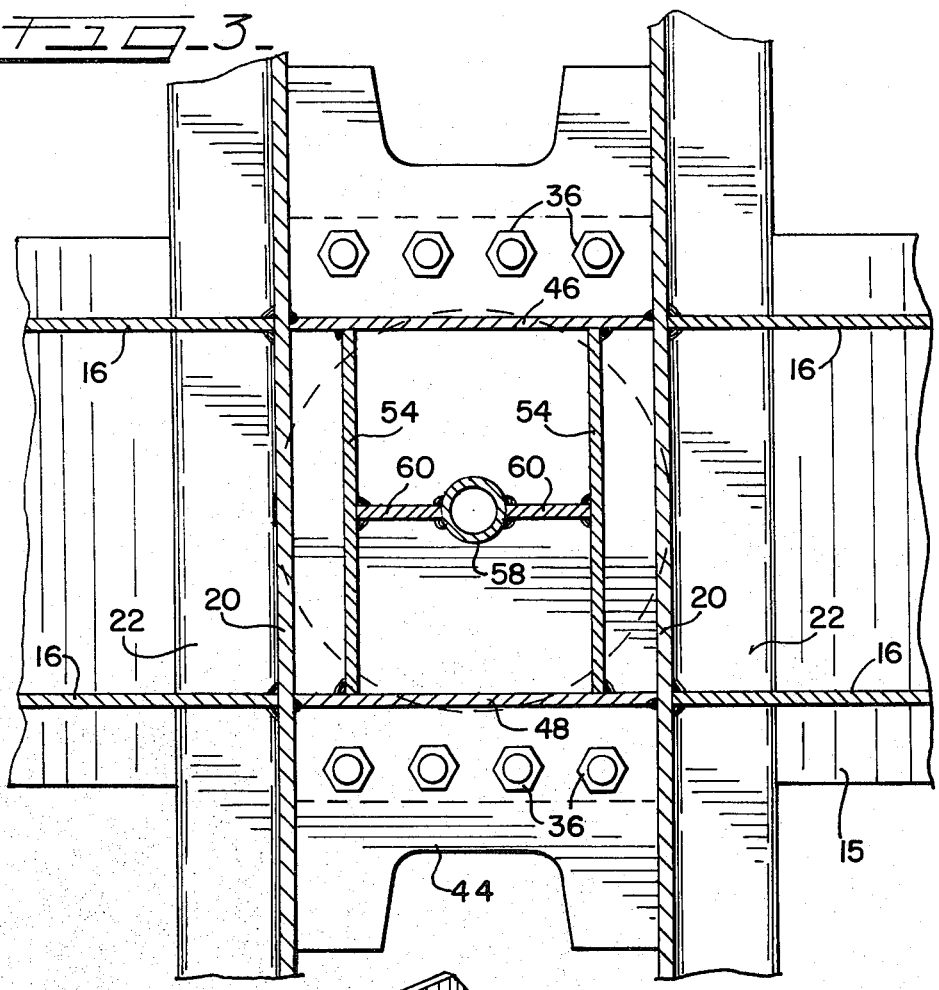
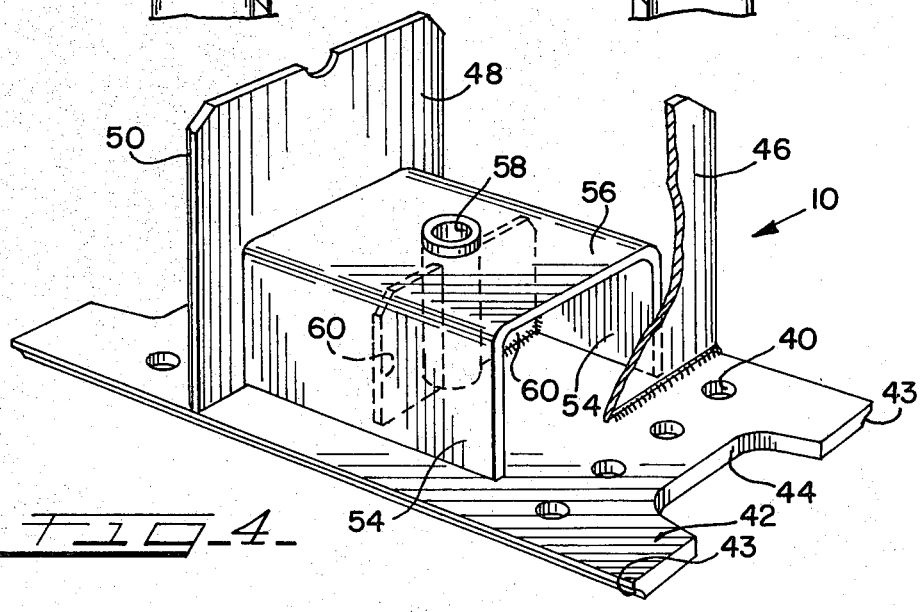
FIG. 4

RAILWAY CAR CENTER FILLER

BACKGROUND OF THE INVENTION

1. Field of the Invention

This disclosure pertains to a center filler assembly for railway vehicles and in particular to a modular or easily replaced and fabricated unit.

2. Description of the Prior Art

Prior art attempts at reinforcing the center filler area of railway vehicles generally have involved a so-called spider unit which provides a cross-shaped assembly of reinforcing plates extending from webs of the draft sill and extending from the front and rear cover plates of the center filler assembly to be joined at the center pin guide tube. This type of design is present in the Tesseyman, et al. U.S. Pat. No. 2,143,216 which shows the usual spider type of center filler assembly along with a number of other, non spider type reinforcing arrangements which have been used in the past. Another type of center filler arrangement not utilizing the usual cross-shaped reinforcement members is shown in the Buzza U.S. Pat. No. 3,985,235 (1976) which shows diagonally extending reinforcing plates located at the bottom of the front and rear cover plates, adjacent the bottom cover plate, and extending upwardly to the center pin guide tube. The Buzza patent also shows a number of other arrangements using diagonal or V-shaped plate arrangements within the center filler pocket. However, neither of these above-discussed patents provide reinforcement at an area inwardly of the webs of the draft sill where high forces are encountered during transit as a car rocks back and forth on the supporting trucks.

The Spence U.S. Pat. No. 4,206,710 shows a center filler arrangement adapted to receive and distribute forces from a bevel line of a center plate by utilizing vertically extending plates. The Spence patent does not show a channel-shaped member having a horizontal top plate to interconnect and rigidify the vertical plates and the center filler end plates. The structure shown herein is designed specifically to resist these high forces which are encountered during transit and which are the source of fatigue failures and high stresses in the center filler and bolster area of the railway vehicle.

SUMMARY OF THE INVENTION

This disclosure pertains to a center filler arrangement designed to be easily assembled and installed in a railway car and adapted particularly to receive and distribute high stresses encountered during car movement when excessive rocking of the car occurs. More specifically, the design involves an inverted U-shaped core member having a top with an opening surrounding the center pin guide tube and including downwardly extending legs. The legs are located inwardly of the sides of the center filler pocket and are securely attached to the center filler bottom cover plate. The legs are aligned with that part of the center plate through which high forces are passed as the car rocks and the center plate is tilted from its mating bowl and only line contact occurs between the center plate cylinder and the center plate bowl. When line contacts occur, high center plate forces are generated through a reduced area resulting in extremely high stresses which can cause galling of the center plate and fatigue failures in the bolster and center filler area. The core member provides a box type of reinforcing beam member which interconnects the front and rear cover plates to resist twisting of the center filler.

It is thus an object of this disclosure to provide a high strength, modular center filler arrangement having a core member with downwardly extending legs spaced inwardly of the sides of the center filler and adapted to provide increased structural strength for transmitting forces from the center plate, through the center filler and into the car body.

These and other objects of the disclosure will become apparent to those having ordinary skill in the art with reference to the following description, drawings, and appended claims.

BRIEF DESCRIPTION OF THE DRAWINGS

FIG. 3 is a sectional view taken generally along lines 3—3 of FIG. 2;

FIG. 4 is a cutaway perspective view of the modular center filler unit;

DESCRIPTION OF THE PREFERRED EMBODIMENT

Figure 1:
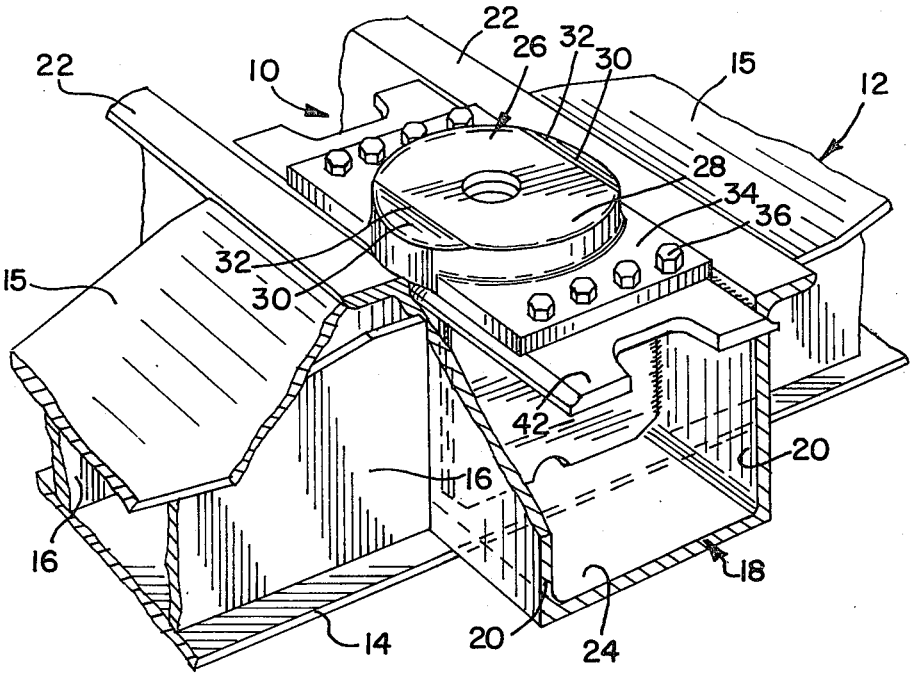
FIG. 1 is a cutaway perspective view of the bolster, center filler and draft sill area of the railway vehicle shown in an inverted position for purposes of clarity.

Referring now to the drawings and in particular to FIG. 1 there is shown a center filler arrangement designated generally by the numeral 10. The center filler is located between the two portions of the so-called bolster beams 12 which include a top plate 14, a bottom plate 15 and spaced, generally parallel side plates 16. Bolster 12 is located adjacent a draft sill 18 which is that portion of the center sill which extends to the coupler and may include a draft gear or a cushioning device. The draft sill 18 includes spaced side webs 20 and outwardly extending lower flanges 22 along with a top 24 which interconnects the space webs 20.

Figure 2:
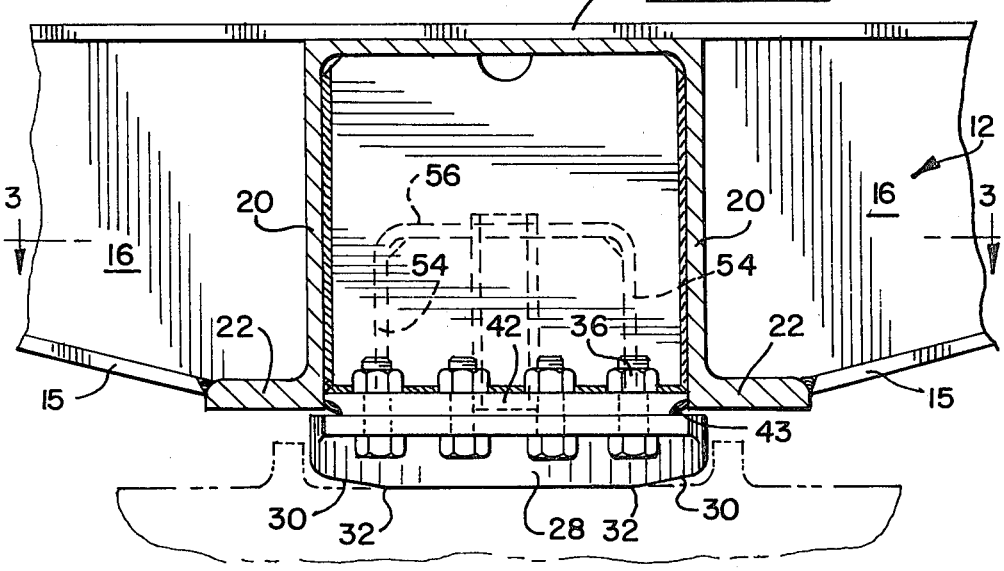
FIG. 2 is a sectional view taken through the draft sill of the vehicle adjacent the center filler area.
Figure 5:
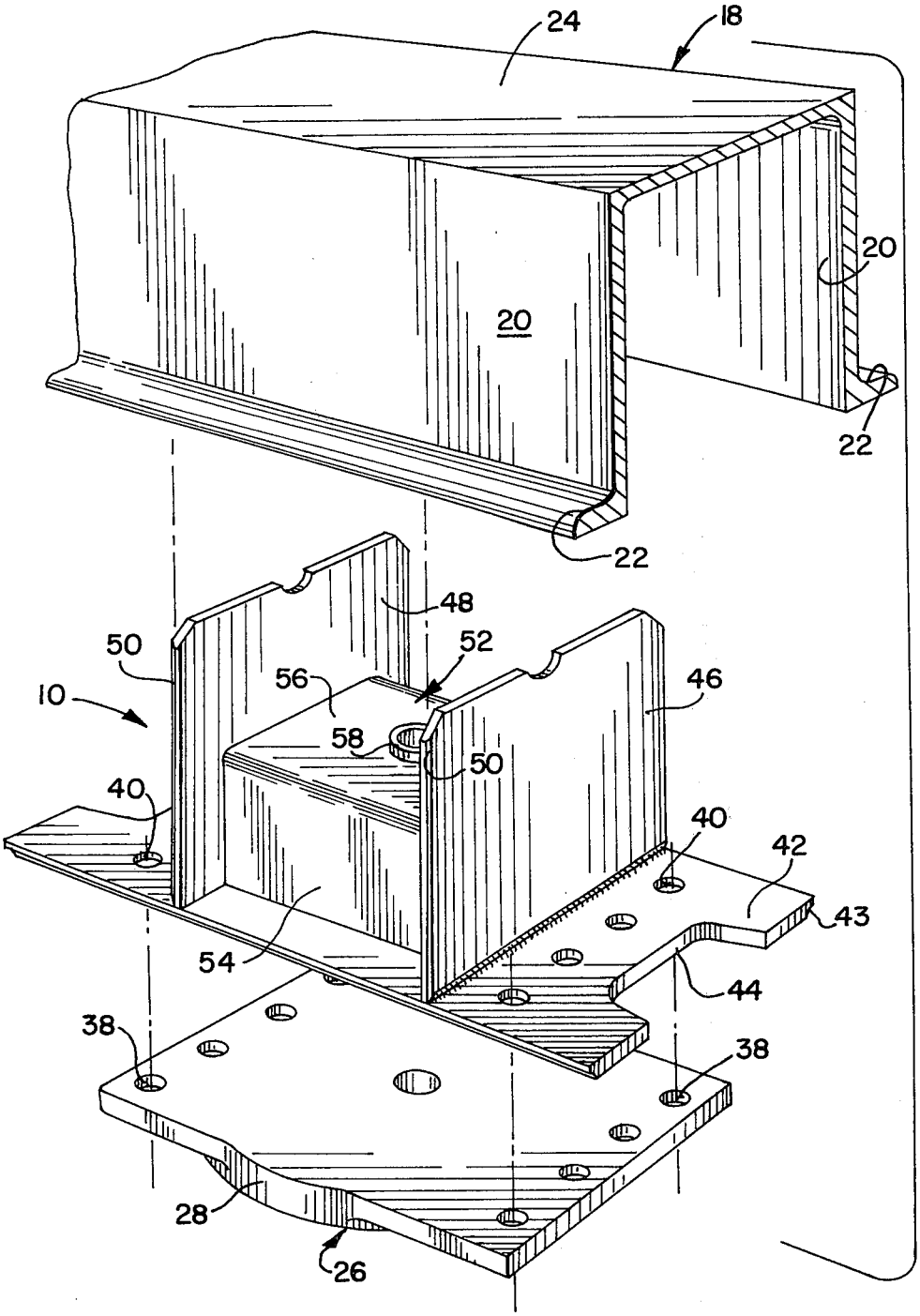
FIG. 5 is an exploded view of the center plate, center filler and draft sill.

A center plate unit is designated generally by the numeral 26 and includes the center plate cylinder 28 having spaced transverse, inclined edges 30 which join a flat bottom portion of the center plate 28 at a so-called bearing line 32. The center plate 26 may be cast as a unit and has attachment flanges 34 with appropriate openings to receive bolts 36 for attachment. As shown in FIG. 5, the openings in the center plate are designated by the numeral 38 and aligned with associated openings 40 in the bottom cover plate 42 of the center filler unit 10. As shown in FIG. 2, the bottom cover plate 42 is adapted to locate the center filler 10 in the center filler pocket at a point where bottom cover plate 42 extends slightly below bottom flanges 22 and is securely attached by a weld located in a cutout 43 of the bottom cover plate 42. By spacing the bottom of bottom cover plate 42 beneath the side flanges 22, the center plate cylinder 28 will not contact the bottom flanges 22 if excessive deflection of the sides of the center plate occurs. Thus, if the center plate deflects or is distorted to an excessive degree, there is no contact with the flanges and consequently no stress concentrations are developed which would cause fracture at the flanges which could migrate and spread throughout the center filler.

As shown in the illustrations, the bottom cover plate may include a cutout 44 provided to allow the bottom cover plate to fit about a draft gear or other type of cushioning device and allow the draft gear to be inserted and removed from into the draft sill without interference.

The modular center filler unit 10 includes upwardly extending front and rear cover plates 46, 48 having upstanding edges which are contoured at 50 to allow the plates to be securely attached within the center filler pocket.

A core member is designated 52 and includes a pair of spaced, downwardly extending legs 54 and a top 56. Top 56 may include an opening which fits about a center pin guide tube 58. A pair of stiffeners 60 are located within the core 52 and are attached to the top 56, the legs 54, and to the center pin guide tube 58 and to bottom cover plate 42.

Upon insertion of the center filler unit and attachment to the car draft sill, it is noticed that as rocking of the car occurs (see FIG. 2) the inclined surfaces 30 will come in contact with the bowl portion of the truck bolster and provide surface contact between the two members. However, as rolling of the center plate occurs, surface contact between the major portion of the cylinder 28 and the bowl transfers to surface contact between the inclined side edges 30 and the side part of the center plate bowl. Thus, for a period of time line contact can occur between the lines 32 and the center plate bowl. When this type of contact arises, high forces travel through a very small area of the center plate 28. Prohibitive stresses can occur which may result in fatigue and premature failures of the center filler portion of the vehicle. Consequently, by positioning core 52 with legs 54 connecting into the bottom cover plate 42 at the point where the high forces are transmitted into the center filler 10, these high forces can be resisted and evenly transmitted into the car body. Thus, the large forces are not transmitted directly into the lower flanges 22, but are distributed into the core 52 and reduced forces are passed into the flanges 22.

It has thus been shown by the foregoing that the center filler arrangement disclosed herein is particularly adapted to prevent premature failure of the center filler unit by providing force transmission members, reinforcing plates, as close as possible to the points where high forces occur to thereby distribute these forces into the car body and prevent high localized forces and stress concentrations which can cause fatigue failures and premature failure and cracking. The hollow, channel shaped core 52 is securely attached to front and rear cover plates 46, 48 and thereby produces an enclosed box beam which resists twisting to further ridigify the center filler 10.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A modular center filler for railway vehicles for providing a high strength area in a center filler pocket located within a draft sill of the vehicle at the junction of a car bolster and said draft sill, comprising:

a bottom cover plate having means for attachment to an associated center plate;

front and rear cover plates attached to the bottom cover plate and extending upwardly therefrom at substantially right angles for generally the height of the center filler pocket;

a core member disposed between said front and rear cover plates;

said core member having upstanding, substantially parallel legs spaced inwardly from the sides of said draft sill and having ends attached to the front and rear cover plates, and having a top cover intermediate of and interconnecting the parallel legs, said core forming a hollow beam interconnecting the front and rear cover plates with the bottom cover plate; and center pin guide means located and secured within the core member extending from the bottom cover plate to an opening in the top cover of the core member.

2. The modular center filler of claim 1 wherein said railway vehicle includes a center plate having a general cylindrical configuration with a flat bottom and sloped, transverse edges providing sloped surfaces extending longitudinally of the draft sill and providing bearing lines at the junctions of the flat bottom and the sloped edges: and said upstanding, parallel legs of the core being attached to the bottom cover plate above and in line with respective bearing lines of said center plate to thereby facilitate transmission of forces generated along said bearing lines to said legs.

3. The modular center filler of claim 1 wherein:

said car bolster includes a pair of spaced side plates attached to and extending transversely of each side of said draft sill; and said front and rear cover plates substantially aligned with said respective side plates.

4. The modular center filler of claim 1 wherein said center pin guide means include:

rigidifying means extending transversely of and connected to each leg of the core member thereby forming a plurality of compartments to facilitate the transmission of center plate forces into the core member and into the car structure.

5. The modular center filler of claim 4 wherein:

said rigidifying means situated midway between the ends of said core member; and said rigidifying means welded to each of said legs and to said center pin guide means.

6. The modular center filler of claim 2 wherein:

said front and rear cover plates being contoured at their lateral edges.

7. The modular center filler of claim 1 wherein:

said railway vehicle includes a center plate; and said bottom cover plate includes side edges extending below and attached to said draft sill.

8. The modular center filler of claim 7 wherein:

said bottom cover plate having front and rear extensions having means for attachment of said center plate.

* * * * *